166-274
FIP7912 XR 4,133,382 SR

United States Patent [19]
Cram et al.

[11] 4,133,382
[45] Jan. 9, 1979

[54] RECOVERY OF PETROLEUM FROM VISCOUS PETROLEUM-CONTAINING FORMATIONS INCLUDING TAR SANDS

[75] Inventors: Phillip J. Cram; Roman A. Pachovsky, both of Calgary, Canada

[73] Assignee: Texaco Canada Inc., Calgary, Canada

[21] Appl. No.: 837,078

[22] Filed: Sep. 28, 1977

[51] Int. Cl.[2] ..... E21B 43/22; E21B 43/24
[52] U.S. Cl. ..... 166/263; 166/261; 166/272; 166/274
[58] Field of Search ..... 166/272, 274, 261, 256, 166/267, 271, 263

[56] References Cited

U.S. PATENT DOCUMENTS

| | | | |
|---|---|---|---|
| 2,862,558 | 12/1958 | Dixon | 166/272 |
| 2,906,337 | 9/1959 | Hennig | 166/272 X |
| 3,263,750 | 8/1966 | Hardy | 166/261 X |
| 3,399,721 | 9/1968 | Strange | 166/272 X |
| 3,830,300 | 8/1974 | Allen | 166/261 |
| 3,945,435 | 3/1976 | Barry | 166/267 |
| 3,946,810 | 3/1976 | Barry | 166/272 |
| 3,993,132 | 11/1976 | Cram et al. | 166/261 |
| 4,006,778 | 2/1977 | Redford et al. | 166/261 |

*Primary Examiner*—Stephen J. Novosad
*Attorney, Agent, or Firm*—Thomas H. Whaley; Carl G. Ries; Charles L. Bauer

[57] ABSTRACT

A method for the in-situ recovery of low API gravity oils or bitumen from subterranean hydrocarbon-bearing formations wherein the recovery is optimized by the injection of a mixture of an oxygen-containing gas and steam until the recovery efficiency declines, followed by the injection of a mixture of light hydrocarbon and steam, under operating conditions that may utilize pressurization and drawdown cycles.

28 Claims, 3 Drawing Figures

RECOVERY OF PETROLEUM FROM VISCOUS PETROLEUM-CONTAINING FORMATIONS INCLUDING TAR SANDS

BACKGROUND OF THE INVENTION

This invention relates to an improved method for the in-situ recovery of oil from subterranean hydrocarbon-bearing formations containing low API gravity oil or bitumen. More particularly, the invention relates to an in-situ recovery method wherein improved recovery is realized by optimizing the recovery by the injection of a mixture of an oxygen-containing gas and steam until the recovery efficiency declines, followed by the injection of a mixture of light hydrocarbon and steam, and employing pressurization and drawdown cycles.

The in-situ recovery of low API gravity oil from subterranean hydrocarbon-bearing formations and bitumen from tar sands has generally been difficult. Although some improvement has been realized in the in-situ recovery of heavy oils, i.e., oils having an API gravity in the range of 10° to 25° API, little success has been realized in recovering bitumen from tar sands by in-situ methods. Bitumen can be regarded as a highly viscous oil having an API gravity in the range of about 5° to 10° API and a viscosity in the range of several million centipoise at formation temperature, and contained in an essentially unconsolidated sand, generally referred to as a tar sand.

Extensive deposits of tar sands exist in the Athabasca region of Alberta, Canada. While these deposits are estimated to contain about seven hundred billion barrels of bitumen, recovery therefrom, as indicated above, using conventional in-situ techniques has not been altogether successful. The reasons for the varying degrees of success relate principally to the fact that the bitumen is extremely viscous at the temperature of the formation, with consequent very low mobility. In addition, the tar sand formations have very low permeability, despite the fact they are unconsolidated.

Since it is known that the viscosity of a viscous oil decreases markedly with an increase in temperature, thereby improving its mobility, thermal recovery techniques have been investigated for recovery of bitumen from tar sands. These thermal recovery methods generally include steam injection, hot water injection and in-situ combustion.

Typically, such thermal techniques employ an injection well and a production well traversing the oil-bearing or tar sand formation. In a conventional throughput steam operation, steam is introduced into the formation through an injection well. Upon entering the formation, the heat transferred by the hot fluid to the formation fluid lowers the viscosity of the oil, thereby improving its mobility, while the flow of the hot fluid serves to drive the oil toward the production well from which it is produced.

Thermal techniques employing steam also utilize a single well technique, known as the "huff and puff" method. In this method, steam is injected via a well in quantities sufficient to heat the subterranean hydrocarbon-bearing formation in the vicinity of the well. Following a period of soak, during which time the well is shut-in, the well is placed on production. After production has declined, the huff and puff technique may again be employed on the same well to again stimulate production. In its application to a field pattern, the huff and puff technique may be phased so that numerous wells are on an injection cycle while others are on a production cycle, which cycles are then reversed.

In the conventional forward in-situ combustion, an oxygen-containing gas, such as air, is introduced into the formation via a well and combustion of in-place crude is initiated adjacent the wellbore. Temperatures of the combustion generally are in the range of 600° to 1200° F. Thereafter, the injection of the oxygen-containing gas is continued so as to maintain a combustion front by burning a portion of the in-place crude or a carbonized deposit resulting from the high temperatures. The injected gas also drives the front through the formation toward a production well. As the combustion front advances through the formation a swept zone consisting ideally of clean sand is created behind the front. Contiguous zones are built up ahead of the front that may include a distillation and cracking zone and a condensation and vaporization zone. The formation of these zones is dependent principally upon the temperature gradients that are created in the formation. As these zones are displaced through the formation, a zone of high oil saturation or an oil bank is established ahead of them, which zone or bank is also displaced toward the production well from which production occurs.

Among the improvements relating to in-situ combustion described in prior art is the injection of water either simultaneously or intermittently with the oxygen-containing gas to scavenge the residual heat, thereby increasing the recovery of oil. Prior art also discloses regulation of the amount of the water injected with the air to improve conformance or sweep efficiency.

Experience has generally shown that in the application of these conventional thermal techniques to the recovery of low API gravity oils and particularly to bitumen recovery from tar sands, conventional thermal techniques have their shortcomings. For example, one difficulty has been that, as the build-up of the oil bank occurs ahead of the thermal front and is displaced through the formation, the bank cools and hence the oil again becomes immobile. The result is that plugging of the formation occurs, thereby making the injection of either the oxygen-containing gas in the case of in-situ combustion, or steam in the case of steam, no longer possible.

An improved thermal method of recovery for low API gravity oil or bitumen from tar sands has been disclosed in U.S. Pat. No. 4,006,778, which utilizes a controlled low-temperature oxidation. According to its teaching, a mixture of an oxygen-containing gas and steam is injected into the formation to generate, and thereafter control, an in-situ low-temperature oxidation. The mixture is injected at a temperature corresponding to the temperature of saturated steam at the pressure of the formation. By this method, the temperature is established and is controlled in the formation at a temperature much lower, i.e., generally in the range of 250° to 500° F., than that of the conventional in-situ combustion process. One of the advantages of the method is the minimization of coking in the formation, which in the conventional in-situ combustion may be excessive and lead to blockage of the formation.

Prior art also teaches the recovery of oil by use of solvents, especially hydrocarbon solvents, either at ambient or elevated temperature. One method is described in U.S. Pat. No. 3,608,638 which employs the injection of a hot hydrocarbon solvent such as toluene or kerosene. The solvent functions principally by dissolving the oil, thereby decreasing viscosity and improving mobility of the fluid. It is also well-known to employ a mixture of hydrocarbon solvent and steam for the recovery of bitumen from tar sand. It is believed that recovery is enhanced by the use of the steam and hydrocarbon mixture because not only is the viscosity of the tar reduced, but also displacement through the sand occurs more rapidly than is possible by the injection of either steam alone or a hydrocarbon solvent. Such a method is described in U.S. Pat. No. 2,862,558 in which a mixture of steam and a normally liquid hydrocarbon is injected into a tar sand formation at a temperature of about 225° to 500° F. and at a pressure of at least 20 psig. More recently, patent literature has described the use of mixtures of depentanized naphtha and steam for recovery of bitumen from tar sand such as described in U.S. Pat. No. 3,945,435 and U.S. Pat. No. 3,946,810. These patents teach that the solvent, having a high aromatic content, is produced from the recovered hydrocarbon and reinjected into the formation with steam at a temperature in the range of 200° to 650° F.

We have now found that, by utilizing a two-step sequence employing the injection of a mixture of an oxygen-containing gas and steam followed by the injection of a mixture of a light hydrocarbon and steam, together with the employment of pressurization and drawdown cycles, enhanced recovery is realized that is higher than that obtained using either the mixture of the oxygen-containing gas and steam or the mixture of the light hydrocarbon and steam alone. Switchover from step (1) to step (2) is made after the recovery efficiency, which is optimized during the first step, begins to show a decline.

Accordingly, it is an object of the present invention to provide an optimized in-situ recovery method for low gravity crudes and bitumen that takes advantage of the beneficial aspects of the use of a mixture of an oxygen-containing gas and steam and a mixture of a light hydrocarbon and steam.

SUMMARY OF THE INVENTION

This invention relates to an improved in-situ method for recovering low API gravity oils and more particularly to the production of bitumen from tar sands by the sequential injection of a mixture of an oxygen-containing gas and steam, followed by the injection of a mixture of a light hydrocarbon and steam. The injection of the mixture of an oxygen-containing gas and steam which optimizes the recovery efficiency is continued until the recovery efficiency shows a decline. Thereafter, a mixture of a light hydrocarbon and steam is injected. The process may also utilize pressurization and drawdown cycles during each of the injection phases.

A BRIEF DESCRIPTION OF THE FIGURES

FIG. 1 compares the bitumen recovery (%) versus steam injected (pore volume) among tests employing the injection of mixtures of air and steam and mixtures of light hydrocarbon and steam.

FIG. 2 illustrates the recovery efficiency (pore volume bitumen produced/pore volume steam injected) versus steam injected (pore volume) among tests employing the injection of mixtures of air and steam and mixtures of light hydrocarbon and steam.

FIG. 3 gives the bitumen recovery (%) versus steam injected (pore volume) for the recovery scheme utilizing the sequential injection of a mixture of air and steam followed by the injection of a mixture of light hydrocarbon and steam.

DESCRIPTION OF THE PREFERRED EMBODIMENT

Figure 1:
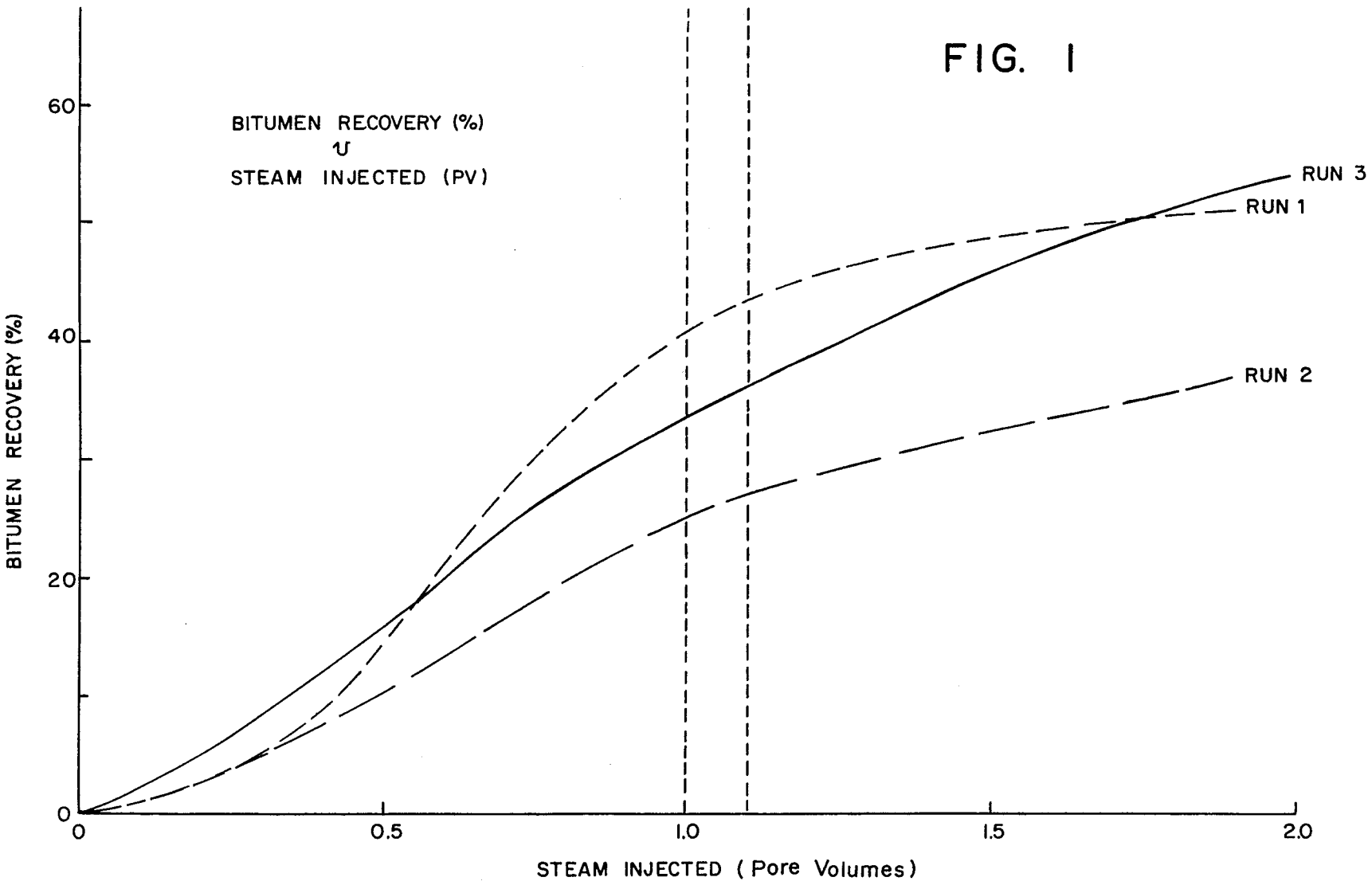

In its broadest aspect this invention relates to an optimized method of in-situ recovery for low API gravity oils or bitumen from tar sands by exploiting the benefits of the injection of a mixture of an oxygen-containing gas and steam and the injection of a mixture of a light hydrocarbon and steam. More particularly, the method is applied to a tar sand formation that is traversed by at least one injection well and one production well and between which there is a communication path or zone of fluid transmissibility.

By the method of the instant invention, a mixture of an oxygen-containing gas and steam is injected into the formation and a low-temperature oxidation is established and controlled therein at a temperature much lower than the temperature of the conventional in-situ combustion process. Injection of the mixture is continued until the maximum recovery efficiency that has been attained begins to decline. By recovery efficiency is meant the ratio of the bitumen recovered to the steam injected (in compatible units, e.g., pore volumes). After the maximum recovery efficiency begins to decline, the injection of the mixture of the oxygen-containing gas and steam is terminated and the injection of a mixture of a light hydrocarbon and steam is undertaken whereby the optimization of recovery of bitumen is continued. In the operation, pressurization and drawdown cycles may be employed.

In the first step of the invention the injection of a mixture of an oxygen-containing gas and steam is undertaken at a temperature corresponding to the temperature of saturated steam at the pressure of the formation. A low-temperature oxidation is effected at the temperature of the saturated steam such as is described in U.S. Pat. No. 4,006,778. It is desirable that the injection be accomplished at the maximum flow rate possible consistent with the pressure limitations of the formation. The preferred temperatures of the injected steam are in the range of 250° to 500° F., corresponding to the temperature of the saturated steam at the pressure of the formation. The quality of the steam may be in the range of 60% up to about 100%, with the higher quality preferred, although comparable results have been obtained at lower qualities. Quality of steam is defined as the weight percent of dry steam contained in one pound of wet steam.

The oxygen-containing gas may be air, or a mixture of oxygen and non-condensible gases as nitrogen, carbon dioxide or flue gas, or it may be substantially pure oxygen. By the term "oxygen-containing gas" is meant that the gas mixture contains free oxygen as one component. The ratio of the free oxygen in the oxygen-containing gas to the steam injected is generally in the range of about 30 SCF/bbl steam to 130 SCF/bbl steam. In the situation where air is used, the ratio of the air to the steam in the mixture is in the range of about 150 SCF/bbl to about 650 SCF/bbl. A preferred range is 170 to 250 SCF air/bbl steam.

Prior to the first step it may be necessary to condition the formation to develop adequate transmissibility in the formation or to stimulate the wells. This may be accomplished by fracturing procedures well-known in the art, and/or by the injection of steam into the wells.

After the injection of the mixture of the oxygen-containing gas and steam has been initiated, and production of fluids (i.e., bitumen) has occurred at the production well, the recovery efficiency is monitored, which recovery efficiency has been heretofore defined as the pore volumes of bitumen recovered to the pore volumes of steam injected. The injection is continued until the recovery efficiency has reached a maximum and begins to decline.

Thereafter, the injection of the mixture of the oxygen-containing gas and steam is terminated and the injection of a mixture of light hydrocarbon and steam is undertaken. As in the first step, it is desirable that the mixture be injected at the maximum flow rate possible consistent with the pressure limitations of the formation. The injection of the mixture of light hydrocarbon and steam is continued until the overall production recovery begins to decrease or production has reached an undesirably low productive level. Thereafter, the sequence of injection steps may be repeated. Thus, the invention may employ a series of injection cycles comprising the steps of injection of a mixture of an oxygen-containing gas and steam, followed by the injection of a mixture of a light hydrocarbon and steam.

The light hydrocarbon that is commingled with the steam may be any suitable solvent such as aliphatic hydrocarbons having from 3 to 10 carbon atoms per molecule, cyclic aromatics, such as benzene or toluene, and naphthenic hydrocarbons. The hydrocarbon may also be natural gasoline, naphtha, kerosene and hydrocarbon mixtures containing aromatic fractions. A preferred solvent is naphtha that is a cut of a refinery stream having a boiling range of about 85° F. to about 460° F.

The ratio of the light hydrocarbon to the steam should be in the range of about 0.03 bbl/bbl to about 0.33 bbl/bbl or about 3 volume % to 33 volume % with the preferred range being about 0.05 bbl/bbl to 0.12 bbl/bbl or 5 volume % to 12 volume %. It is preferred that the commingled steam be saturated steam having a quality in the range of about 60% to about 100%.

It is postulated that the benefits realized from the disclosed sequence relate to the fact that in the first step, using a mixture of an oxygen-containing gas and steam, the low-temperature oxidation that occurs results principally from the mechanism of cleavage of asphaltic clusters with molecular degradation. The process may be considered as a controlled oxidation process wherein the saturated steam partially quenches any incipient burning near the injection point, thereby preventing the temperature from rising to the point of carbonization of the bitumen. With the control of the temperature, the carbon reactions are reduced and the unreacted oxygen is capable of penetrating into the formation so as to propagate the controlled oxidation reaction more extensively throughout the formation.

It is further postulated that the use of the mixture of light hydrocarbon and steam in the second step has the advantage not only of a thermal and solvent action on the bitumen, but also that by vaporization of the solvent a resulting beneficial volume increase occurs. By the combination of the two steps optimized recovery is obtained that is better than the recovery from the use of either step alone.

The optimized recovery realized by the disclosed invention has been demonstrated from the results and analyses of a series of laboratory runs, which will be described in greater detail hereinafter, that investigated the recovery of bitumen from tar sand employing both a mixture of an oxygen-containing gas and steam and a mixture of a light hydrocarbon and steam. These runs showed in all cases that during the early stages of the runs the percent recovery showed the greatest change. Further, the recovery efficiency in all runs rose to a maximum value and then declined after about one pore volume of steam had been injected. The results further demonstrated that the optimum recovery efficiency that is obtained during this stage occurred when the mixture of the oxygen-containing gas and steam was used as compared with a mixture of a light hydrocarbon and steam. Thus, by the method of the invention, the first step in the disclosed sequence employs the injection of a mixture of an oxygen-containing gas and steam.

The results further demonstrated that after the recovery efficiency had peaked, the mixture of the light hydrocarbon and steam outperformed the mixture of the oxygen-containing gas and steam as a recovery mechanism. Thus, again according to the invention, switchover from the first step to the second step is made at the opportune time so that the benefits of both maximum recovery efficiency and maximum overall recovery are realized in optimizing bitumen recovery.

In addition to the above recited advantages, it has been determined that the employment of a pressurization and drawdown cycle during operation imparts further beneficial results leading to enhanced recovery. Pressurization may be accomplished by maintaining the rate of production at a value less than the rate of injection. The injection rate employed should be such that the pressure in the formation is increased to a value approaching the fracturing pressure or to a pressure at the production well of about 60–95% of the injection pressure. Restricting the production rate may be accomplished by, for example, choking back the production wells. Once the desired pressure has been attained, drawdown is initiated by reducing the injection rate and increasing the production rate. The production rate may be increased by producing the production wells under essentially unrestricted conditions until the pressure of the formation declines to some desired lower level. The injection rate during drawdown may be as low as about 20% of the initial injection rate and the pressure decline may be to about 33% of the pressure at the beginning of the drawdown cycle. Drawdown is maintained so long as fluid is produced at a reasonable or economic rate. Once the production has declined below this value, a second pressurization and drawdown cycle may be undertaken. The pressurization and drawdown cycle may be employed during either or both of the injection steps and may be repeated during the injection sequence.

It is believed that the use of the pressurization and drawdown cycle is of benefit in that it accomplishes a periodic cleanout of the communication paths, thereby maintaining transmissibility, which must be maintained if continued production of the formation is to be realized.

Returning now to the series of laboratory runs mentioned above, a series of runs was conducted using a tar sand from the McMurray formation in Alberta, Canada. For each run, approximately 170–190 pounds of tar sand were packed in a cell approximately 15 inches long and 18 inches in diameter. The cell was equipped for operating at controlled temperatures up to 420° F. and pressures up to 500 psia and contained suitable simulated injection and production wells. The sand pack contained many thermocouples so that temperatures throughout the pack could be measured and heat transfer rates could be calculated.

The general procedure employed involved the injection of steam to condition the tar sand pack and to initiate production, after which injection of the fluid under study was undertaken. Injection rates, production rates, temperatures, and pressures were monitored during each run.

In laboratory Run No. 1 a mixture of an oxygen-containing gas (air) and steam was injected at a pressure of about 300 psia and a temperature of 417° F. corresponding to the saturation pressure of steam. The ratio of the air to the steam was about 0.7 SCF per pound of steam or 245 SCF per bbl of steam. The operating scheme employed an initial steam injection period for about one-half hour. Thereafter, a mixture of air and steam was injected for about 1½ hours followed by a pressurization and drawdown cycle period of about 12 hours. The pressurization and drawdown cycle consisted of 10 minutes of injection at a pressure of about 300 psia followed by a drawdown of 30 minutes wherein the simulated production well was produced until the pressure had decreased to about atmospheric pressure. Recovery was approximately 50% after 2 pore volumes of steam had been injected. The results showed that not only was recovery significantly improved by the use of a commingled air and steam mixture as compared with the use of steam only, but also the use of the pressurization and drawdown cycle sharply increased the recovery rate and the conformance.

These results may be compared with those of Run 2 in which steam only was injected and in which, after 2 hours of steam injection, the pressurization and drawdown cycle period was employed for about 18 hours. With the introduction of the pressurization and drawdown cycle, production increased sharply as had been seen in Run 1. But after approximately 2 pore volumes of steam had been injected, recovery was only 36%.

In Run 3 a mixture of a light hydrocarbon (Unifiner naphtha) and steam was injected. The ratio of the naphtha to steam was about 8.9 vol. %. The Unifiner naphtha had a distillation range from an initial boiling point (I.B.P.) of about 86° F. to an end point (E.P.) of about 385° F. Initially steam was injected for approximately 15 minutes and thereafter, the mixture of naphtha and steam was injected for approximately 40 minutes at the temperature corresponding to the temperature of saturated steam at the pressure of the test cell, after which a pressurization and drawdown cycle period was undertaken for approximately 14½ hours. Recovery was about 42.5% after 2 pore volumes of steam had been injected. The results showed that the recovery rates were not so high at the beginning of the run as those with the mixture of air and steam, but there was indication that the use of the pressurization and drawdown cycle sharply increased recovery rates.

In Run 4 the sequential procedure was used, injecting first a mixture of air and steam followed by injecting a mixture of Unifiner naphtha and steam. The operating scheme consisted of an initial steam injection period for approximately one-half hour. Thereafter, the mixture of air and steam was injected in which the ratio of air to steam was about 0.67 SCF/lb. steam or about 235 SCF/bbl. After about half an hour, a pressurization and drawdown cycle period was undertaken in which air and steam were injected for 10 minutes followed by drawdown for 30 minutes. After approximately 11 hours, injection of the mixture was terminated and injection of the mixture of Unifiner naphtha and steam was undertaken in which pressurization and drawdown cycles were again employed. The results show that during the first step of injection of the mixture of air and steam the production rate or recovery efficiency was very high at the start and gradually decreased as the run progressed. The results also show that with the initiation of the injection of the mixture of naphtha and steam the decline in recovery rate was arrested and after about 5 hours of injection, the production rate began to increase.

The results and analyses of these runs are illustrated in the accompanying figures. In FIG. 1 the percent bitumen recovery versus the pore volume of steam injected is plotted for the above-described runs. The figure clearly shows the advantages in terms of recovery of using as the injection fluid a mixture of air and steam (Run 1) or a mixture of light hydrocarbon and steam (Run 3) over straight steam (Run 2). For example, with straight steam (Run 2) aproximately 25% recovery was obtained after one pore volume of steam had been injected. In contrast to this, when a mixture of air and steam was used (Run 1) approximately 42% recovery was obtained, and when a mixture of naphtha and steam was used (Run 3) approximately 32% recovery was obtained after one pore volume of steam had been injected.

FIG. 1 also shows that for all cases the region of most significant change in recovery occurred when about 1.0 to 1.1 pore volumes of steam had been injected. Furthermore, the percent recovery shows the greatest change for the air and steam run. Thereafter, recovery is less for the air and steam run as compared with the light hydrocarbon and steam run.

Figure 2:
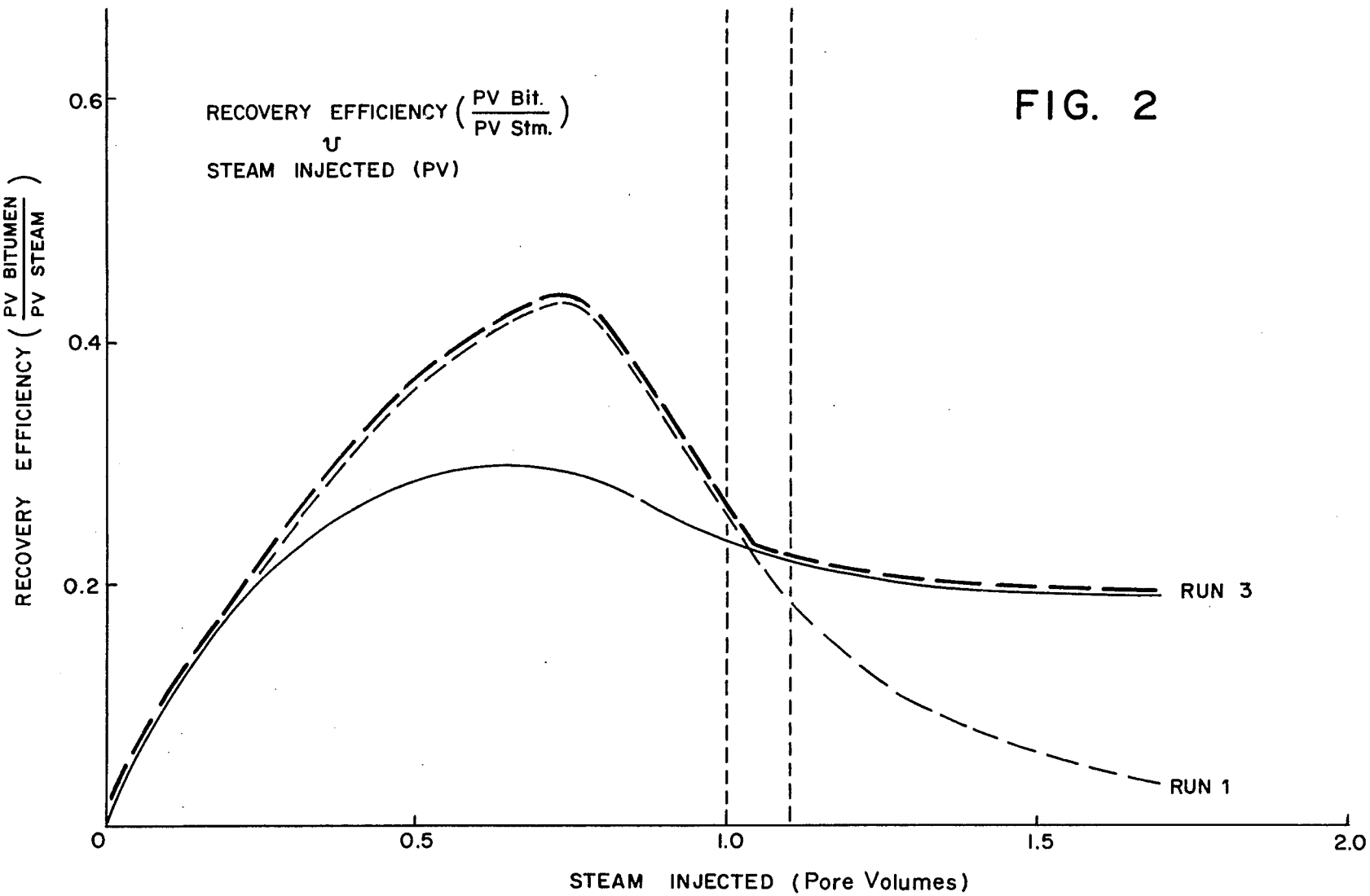

Using these results, the slopes of the curves were then plotted against pore volumes of steam injected, as shown in FIG. 2. These slopes are the recovery efficiency expressed as pore volume bitumen to pore volume steam. The results show that maximum recovery efficiency for both the air and steam mixture (Run 1) and the light hydrocarbon and steam mixture (Run 3) occurs when somewhat less than one pore volume of steam has been injected. The figure also shows that the use of a mixture of air and steam results in optimum performance in terms of recovery efficiency when compared with the mixture of light hydrocarbon and steam. Further, the figure shows that for pore volumes greater than one pore volume of steam injected, the recovery efficiency for the mixture of light hydrocarbon and steam is significantly higher than that for air and steam.

Thus, as disclosed by the instant invention, to optimize bitumen recovery for a given pore volume of steam injected, the general sequence employed is to maximize the recovery efficiency by initiating injection with a mixture of air and steam until the recovery efficiency shows a decline, following which the injection of the mixture of air and steam is terminated and the injection of the mixture of light hydrocarbon and steam is initiated. The optimized procedure is shown by the heavy dashed line in FIG. 2.

Figure 3:
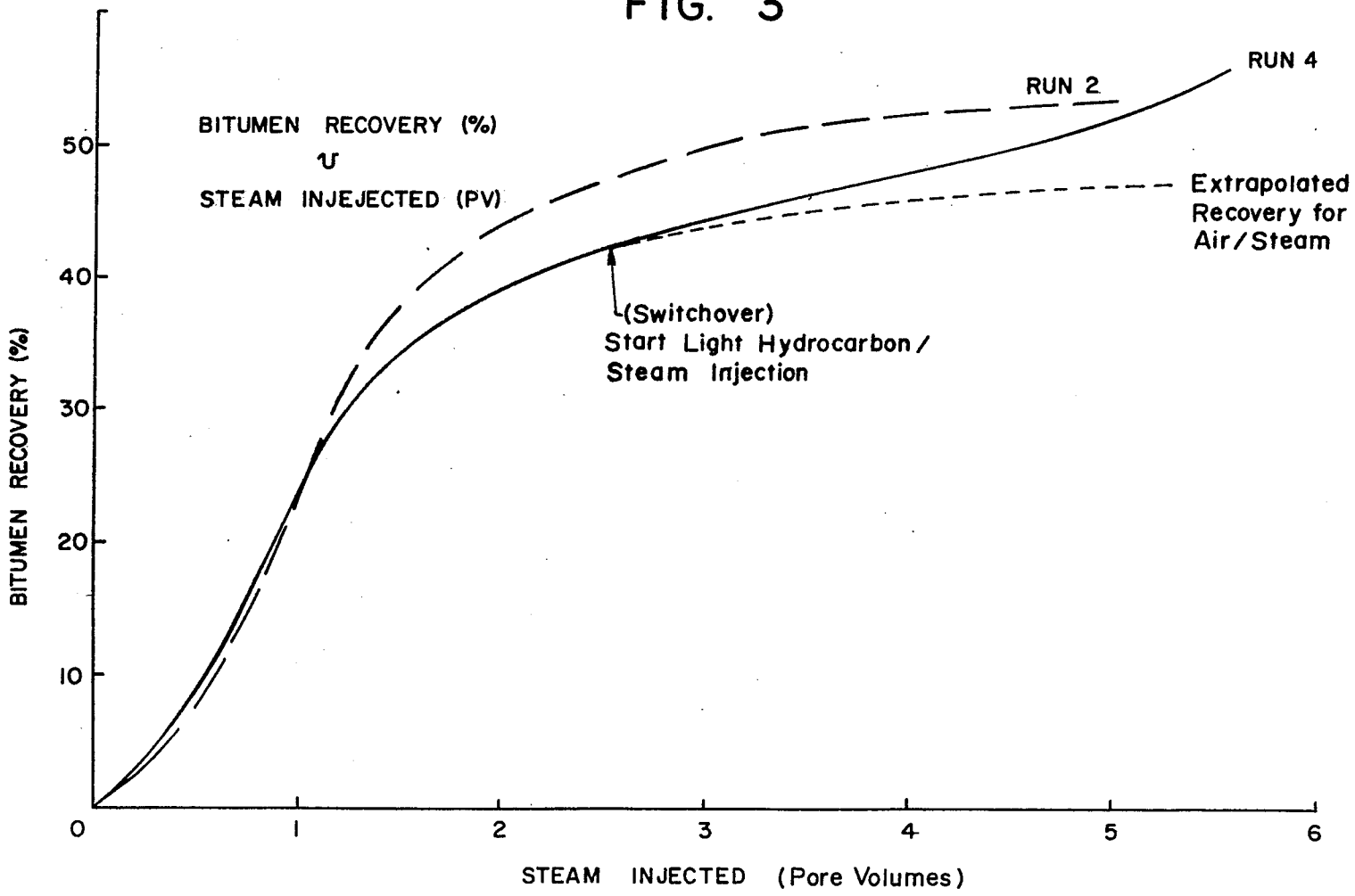

The results of a laboratory run using the procedure is shown in FIG. 3 wherein a mixture of air and steam was injected followed by the injection of a mixture of light hydrocarbon (Unifiner naphtha) and steam, and utilizing pressurization and drawdown cycles. Switchover was made after 2.3 pore volumes of steam had been injected. The results indicate the improved recovery obtained by employing the sequential optimized procedure of the disclosed invention. The observed improvement in recovery is clearly shown in that the recovery continues to increase after switchover, whereas the recovery utilizing the mixture of air and steam has leveled off.

In summary, in accordance with the invention improved recovery of heavy oil or bitumen is accomplished by an optimized procedure in which a mixture of an oxygen-containing gas and steam is injected at a temperature corresponding to the temperature of saturated steam at the pressure of the formation until maximum recovery efficiency has been realized, followed by the injection of a light hydrocarbon and steam. Pressurization and drawdown cycles may be utilized in each step.

We claim:

1. A method for the recovery of hydrocarbons from a subterranean hydrocarbon-bearing formation traversed by at least one injection well and one production well and having fluid communication therebetween, comprising the steps of:

(a) injecting via said injection well a first mixture comprising an oxygen-containing gas and steam, until the maximum recovery efficiency has been attained and starts to decline and simultaneously producing said formation hydrocarbons via said production well, (b) terminating injection of said first mixture and undertaking injection of a second mixture comprising a light hydrocarbon and steam and continuing to produce said formation hydrocarbons via said production well, wherein a pressurization and drawdown cycle is employed during at least one of said steps (a) and (b).

2. The method of claim 1 wherein steam is injected into said injection and/or said production wells to condition said formation, prior to the injection of said first mixture.

3. The method of claim 1 wherein said injected steam has a quality of less than 100%.

4. The method of claim 1 wherein said first mixture is injected at a temperature corresponding to the temperature of saturated steam at the pressure of said formation.

5. The method of claim 1 wherein the ratio of the free oxygen in said oxygen-containing gas to steam in said first mixture is in the range of about 30 to 130 SCF per barrel of steam.

6. The method of claim 1 wherein said formation is first repressured to a pressure corresponding to a temperature for saturated steam in the range of 250°–500° F.

7. The method of claim 1 wherein said mixture of oxygen-containing gas and steam is injected until about 1 to 1.1 pore volume of steam at reservoir conditions has been injected.

8. The method of claim 1 wherein said oxygen-containing gas is air, enriched oxygen, or substantially pure oxygen.

9. The method of claim 1 wherein the ratio of light hydrocarbon to steam in said second mixture is in the range of about 3.0 vol. % to 33.0 vol. %.

10. The method of claim 1 wherein said light hydrocarbon comprises aliphatic hydrocarbons having from 3 to 10 carbon atoms per molecule, cyclic aromatics, naphthenic hydrocarbons and mixtures thereof.

11. The method of claim 1 wherein said light hydrocarbon is natural gasoline, naphtha, kerosene, and mixtures thereof.

12. The method of claim 1 wherein said light hydrocarbon is a cut of a refinery stream having a boiling range of about 85° F. (I.B.P.) to about 460° F. (E.P.).

13. The method of claim 1 wherein steps (a) and (b) are repeated when production has reached an undesirably low level.

14. The method of claim 1 wherein said pressurization and drawdown cycle comprises:

(a) pressurization wherein the rate of production is less than the rate of injection, (b) drawdown wherein the rate of production is greater than the rate of injection.

15. The method of claim 1 wherein said pressurization and said drawdown cycle comprises:

(a) pressurization wherein said injection mixture is injected at a rate until the pressure at said production well is increased to about 60% to about 95% of the injection pressure and said production well is produced at restricted conditions, (b) drawdown wherein said injection mixture is injected at a rate of about 20% to about 33% of the initial injection rate and said production well is produced at essentially unrestricted conditions.

16. The method of claim 1 wherein said pressurization and drawdown cycle is repeated.

17. A method for the recovery of bitumen from a tar sand formation traversed by at least one injection well and at least one production well comprising the steps of:

(a) injecting via said injection well a first mixture to an oxygen-containing gas and steam said steam having a quality less than 100% and said mixture being injected at a temperature corresponding to the temperature for saturated steam at the pressure of said formation, while simultaneously producing said formation bitumen via said production well, (b) terminating injection of said first mixture after the maximum recovery efficiency has been attained and injecting a second mixture of a light hydrocarbon and steam while continuing to produce said formation bitumen via said production well, wherein a pressurization and drawdown cycle is employed during at least one of said steps (a) and (b).

18. The method of claim 17 wherein steps (a) and (b) are repeated when production has reached an undesirably low level.

19. The method of claim 17 wherein steam is injected into said injection and/or said production wells to condition said formation prior to the injection of said first mixture.

20. The method of claim 17 wherein the ratio of free oxygen in said oxygen-containing gas to steam in said first mixture is in the range of about 30 to 130 SCF/bbl of steam.

21. The method of claim 17 wherein said formation is first repressured to a pressure corresponding to a temperature for saturated steam in the range of 250° to 500° F.

22. The method of claim 17 wherein said mixture of oxygen-containing gas and steam is injected until about 1 to 1.1 pore volumes of steam at reservoir conditions has been injected.

23. The method of claim 17 wherein said oxygen-containing gas is air, enriched oxygen or substantially pure oxygen.

24. The method of claim 17 wherein the ratio of light hydrocarbon to steam in said second mixture is in the range of about 3.0 vol. % to 33.0 vol. %.

25. The method of claim 17 wherein said light hydrocarbon comprises aliphatic hydrocarbons having from 3 to 10 carbon atoms per molecule, cyclic aromatics, naphthenic hydrocarbons, and mixtures thereof.

26. The method of claim 17 wherein said light hydrocarbon is natural gasoline, naphtha, kerosene and mixtures thereof.

27. The method of claim 17 wherein said pressurization and drawdown cycle comprises:

(a) pressurization wherein the rate of production is less than the rate of injection, (b) drawdown wherein the rate of production is greater than the rate of injection.

28. The method of claim 17 wherein said pressurization and drawdown cycle is repeated.

* * * * *